US010301709B2

(12) United States Patent
Bassi et al.

(10) Patent No.: US 10,301,709 B2
(45) Date of Patent: May 28, 2019

(54) SHOCK HEAT TREATMENT OF ALUMINUM ALLOY ARTICLES

(71) Applicant: Novelis Inc., Atlanta, GA (US)

(72) Inventors: Corrado Bassi, Salgesch (CH); Aude Despois, Grône (CH); Julie Richard, Sion (CH)

(73) Assignee: NOVELIS INC., Kennesaw, GA (US)

( * ) Notice: Subject to any disclaimer, the term of this patent is extended or adjusted under 35 U.S.C. 154(b) by 75 days.

(21) Appl. No.: 15/145,477

(22) Filed: May 3, 2016

(65) Prior Publication Data

US 2016/0326619 A1 Nov. 10, 2016

Related U.S. Application Data

(60) Provisional application No. 62/158,727, filed on May 8, 2015.

(51) Int. Cl.
*C22F 1/04* (2006.01)
*C22F 1/05* (2006.01)
(Continued)

(52) U.S. Cl.
CPC ..... *C22F 1/05* (2013.01); *C22C 21/00* (2013.01); *C22C 21/08* (2013.01); *C22F 1/04* (2013.01)

(58) Field of Classification Search
None
See application file for complete search history.

(56) References Cited

U.S. PATENT DOCUMENTS 5,948,185 A 9/1999 Krajewski et al.
6,224,992 B1 5/2001 Delbeke et al.
(Continued)

FOREIGN PATENT DOCUMENTS

CA 2372736 A1 11/2000
CA 2286055 C 11/2003
(Continued)

OTHER PUBLICATIONS

Esmaeili, S. et al., "On the Precipitation-Hardening Behavior of the Al—Mg—Si—Cu Alloy AA6111," Metallurgical and Materials Transactions A, Mar. 2003, pp. 751-763, vol. 34A, Springer US.
(Continued)

*Primary Examiner* — Matthew E. Hoban
*Assistant Examiner* — Rajinder Bajwa
(74) *Attorney, Agent, or Firm* — Kilpatrick Townsend & Stockton LLP

(57) ABSTRACT

Processes for improving the strength of heat-treatable, age hardenable aluminum alloys, such as 6xxx, 2xxx and 7xxx aluminum alloys, are provided. The processes for improving the strength of heat-treatable, age-hardenable aluminum alloys involve a heat treatment step, termed "shock heat treatment," which involves heat treatment at 200 to 350° C. that is conducted at a fast heating rate (for example 10 to 220° C./seconds) for a relatively short period of time (for example, for 60 seconds or less or for 5 to 30 seconds). In some examples, the shock heat treatment is accomplished by contact heating, such as heating an aluminum alloy article between complementary shaped heated dies of a press. Aluminum alloy articles, such as automotive panels, produced by the disclosed shock heat treatment are also provided.

14 Claims, 13 Drawing Sheets

(51) Int. Cl.
*C22C 21/00* (2006.01)
*C22C 21/08* (2006.01)

(56) References Cited

U.S. PATENT DOCUMENTS

| | | | | |
|---|---|---|---|---|
| 6,280,543 | B1 | 8/2001 | Zonker et al. | |
| 6,284,014 | B1 | 9/2001 | Carden | |
| 6,423,164 | B1 | 7/2002 | Bryant et al. | |
| 8,211,251 | B2 | 7/2012 | Carsley et al. | |
| 8,663,405 | B2 | 3/2014 | Krajewski | |
| 9,453,273 | B2 | 9/2016 | Matsumoto et al. | |
| 2002/0174920 | A1 | 11/2002 | Gupta et al. | |
| 2006/0016523 | A1 | 1/2006 | Dif et al. | |
| 2008/0041501 | A1 | 2/2008 | Platek et al. | |
| 2009/0148721 | A1 | 6/2009 | Hibino et al. | |
| 2010/0012236 | A1 | 1/2010 | Hong et al. | |
| 2010/0024924 | A1* | 2/2010 | Krajewski | C22F 1/06 148/510 |
| 2012/0186706 | A1 | 7/2012 | Krajewski | |
| 2013/0068351 | A1 | 3/2013 | Kamat et al. | |
| 2013/0269843 | A1* | 10/2013 | Wust | C21D 1/60 148/698 |
| 2014/0069557 | A1 | 3/2014 | Smeyers, Sr. et al. | |
| 2015/0007909 | A1* | 1/2015 | Matsumoto | C22C 21/02 148/418 |
| 2015/0125713 | A1* | 5/2015 | Harrison | B32B 7/08 428/594 |

FOREIGN PATENT DOCUMENTS

| | | | |
|---|---|---|---|
| CN | 104114726 | | 10/2014 |
| DE | 69800931 | T2 | 1/2002 |
| DE | 69923742 | T2 | 1/2006 |
| EP | 0931170 | A1 | 7/1999 |
| EP | 1190109 | B1 | 11/2003 |
| EP | 1392877 | B1 | 8/2011 |
| GB | 1493491 | A | 11/1977 |
| GB | 2504005 | A | 1/2014 |
| JP | 6287725 | | 10/1994 |
| JP | 2003328095 | | 11/2003 |
| JP | 2011017063 | | 1/2011 |
| JP | 2015101756 | | 6/2015 |
| KR | 100964855 | B1 | 6/2010 |
| RU | 2326182 | | 6/2008 |
| RU | 2341585 | | 12/2008 |
| WO | 0070115 | A1 | 11/2000 |
| WO | 2009132436 | A1 | 11/2009 |

OTHER PUBLICATIONS

International Application No. PCT/US2016/030575, International Search Report and Written Opinion dated Jun. 20, 2016, 10 pages.
PCT/US2016/030575, "International Preliminary Report on Patentability", dated Nov. 23, 2017, 7 pages.
Australian Application No. 2016261193 , "Notice of Allowance", dated Nov. 13, 2018, 3 pages.
Canadian Application No. 2,985,070 , "Office Action", dated Nov. 22, 2018, 4 pages.
Chinese Application No. 201680026474.0 , "Office Action", dated Sep. 28, 2018, 7 pages.
Japanese Application No. 2017-558427 , "Office Action", dated Dec. 4, 2018, 7 pages.
Liu et al., "Application and Development of aluminum alloy material", Jun. 30, 2011, pp. 1-3.
Australian Patent Application No. 2016261193, First Examination Report dated Jul. 13, 2018, 3 pages.
Russian Application No. 2017141784 , "Office Action", dated Nov. 9, 2018, 9 pages.

* cited by examiner

SHOCK HEAT TREATMENT OF ALUMINUM ALLOY ARTICLES

CROSS-REFERENCE TO RELATED APPLICATION

This application claims the benefit of U.S. Provisional Patent Application No. 62/158,727, filed May 8, 2015, which is incorporated by reference herein in its entirety.

FIELD OF THE INVENTION

The invention relates to the fields of material science, material chemistry, metallurgy, aluminum alloys, aluminum fabrication, transportation industry, motor vehicle industry, automotive industry, motor vehicle fabrication and related fields.

BACKGROUND

Heat-treatable, age hardenable aluminum alloys, such as 2xxx, 6xxx and 7xxx aluminum alloys, are used for the production of panels in vehicles such as automobiles. These alloys are typically provided to an automotive manufacturer in the form of an aluminum sheet in a ductile T4 state (or temper) to enable the manufacturer to produce the automotive panels by stamping or pressing. To produce functional automotive panels meeting the required strength specifications, the manufacturer has to heat treat the automotive panels produced from an aluminum alloy in T4 temper to increase their strength and convert the aluminum alloy into T6 temper. In automotive manufacturing, the heat treatment is often accomplished for outer automotive panels during a paint bake process of the assembled motor vehicle body. For inner automotive parts, a separate heat treatment is often required, referred to as Post Forming Heat Treatment ("PFHT").

Current processes used in the motor vehicle industry for heat treatment of pressed aluminum automotive panels to increase their strength possess notable disadvantages. Heat treatment during the paint bake cycle of assembled motor vehicle bodies requires paint lines with sufficient heat power to achieve the required temperature, particularly in thick and inner structural elements of a car. Paint bake heat treatment is difficult, particularly for inner automotive panels, because the outer panels act as a heat shield, resulting in uneven hardening of different parts of a motor vehicle body. For example, during a typical paint bake cycle, the outer panels may be exposed to a temperature of 170 to 185° C. for about 20 minutes, which leads to their "bake" hardening. However, during a similar paint bake cycle, the floor panels in an assembled automobile body are exposed to a temperature of only 130 to 160° C. for 10 to 15 minutes, which does not result in significant hardening. Although effective, PFHT is inefficient. For example, a heat treatment at about 225° C. for approximately 30 minutes may be required to get full T6 temper in panels through PFHT. PFHT leads to high energy costs, is time consuming and requires expensive modifications of the production lines. In other words, PFHT adds significant costs to and lengthens motor vehicle production cycles.

SUMMARY

The invention provides aluminum alloy articles and related products and processes, which can be employed in the transportation industry or other industries for production of aluminum alloy parts, such as automobile panels. More generally, the products and processes of the invention can be employed in the fabrication of aluminum parts used in various machinery and mechanisms.

Covered embodiments of the invention are defined by the claims, not this summary. This summary is a high-level overview of various aspects of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification, any or all drawings and each claim.

The terms "invention," "the invention," "this invention" and "the present invention," as used in this document, are intended to refer broadly to all of the subject matter of this patent application and the claims below. Statements containing these terms do not limit the subject matter described herein or to limit the meaning or scope of the patent claims below.

Disclosed is an improved heat treatment process for aluminum alloy articles produced from heat-treatable, age-hardenable aluminum alloys, such as 2xxx, 6xxx, and 7xxx aluminum alloys. The heat treatment processes disclosed herein improve mechanical characteristics of an aluminum alloy article being treated, for example, by increasing its strength. The improved heat treatment processes are significantly shorter and use a very fast heating rate, in comparison with the processes currently employed in the automotive industry to heat treat aluminum panels, such as PFHT. The improved heat treatment processes may be carried out on alloys that are preaged or not preaged.

The disclosed heat treatment processes can be efficiently incorporated into production processes for motor vehicle parts, such as automotive aluminum alloy panels, and can advantageously replace PFHT in automotive production cycles. At the same time, the aluminum alloy articles treated by the improved heat treatment processes are capable of achieving the strength characteristics comparable to those achieved by the use of PFHT. The disclosed heat treatment processes, which may be referred to as "shock heat treatment," can be easily incorporated into the existing automotive production lines used for manufacturing pressed aluminum panels. For example, shock heat treatment stations can be incorporated into the press line of the automotive panel production line to produce heat treated aluminum automotive panels in T6 or T61 temper. The term "T61 temper" is used to denote an intermediate temper between T4 and T6, with higher yield strength but lower elongation than a material in T4 temper, and with lower yield strength but higher elongation than in T6 temper. The term "T4 temper" refers to an aluminum alloy produced without intermediate batch annealing and pre-aging. In addition, the automotive panels may be in the T8 temper. The term "T8 temper" is used to denote an alloy that has been solution heat treated, cold worked, and then artificially aged. The alloys used in the methods described herein may be preaged or not preaged.

While well-suited for heat treatment of automotive aluminum alloy panels during their production, the improved heat treatment processes are more generally applicable to heat treatment of various aluminum alloy articles, such as stamped or pressed aluminum alloy articles, to modulate their mechanical characteristics, for example, to increase their strength. The disclosed processes can incorporate shock heat treatment into the existing processes and lines for production of aluminum alloy articles, such as stamped aluminum articles, thereby improving the processes and the resulting articles in a streamlined and economical manner. In some examples, an improved heat treatment process is accomplished by contact heating using heated tools of appropriate shape to heat the pre-formed aluminum articles. In some examples, a pre-formed aluminum article is subjected to multiple shock heat treatment steps, which may be conducted at different temperatures. Such a combination of shock heat treatment steps achieves desired mechanical properties (for example, strength) of an aluminum article in a shorter time than conventional heat treatment processes. In one example, subsequent to a stamping step, a stamped aluminum alloy article can be, subjected to two or more different contact heating steps at two different temperatures. In another example, subsequent to a stamping step, different parts of a stamped aluminum alloy article can be subjected to local contact shock heating steps to obtain different strength properties in different parts of the aluminum alloy article. Also disclosed are the aluminum alloy articles produced by the improved heat treatment processes, such as motor vehicle aluminum alloy panels. Uses of the resulting automotive aluminum alloy panels for fabrication of motor vehicle bodies are also included within the scope of the invention.

Some exemplary embodiments are as follows. One non-limiting example is a process for increasing the strength of a shaped aluminum alloy article produced from an age-hardenable, heat-treatable aluminum alloy, including heating one or more times at least a part of the shaped aluminum alloy article produced from the age-hardenable, heat-treatable aluminum alloy to a heat treatment temperature of 250 to 300° C. at a heating rate of 10 to 220° C./second, and maintaining the heat treatment temperature for 60 seconds or less. Another example is a process for producing a shaped aluminum alloy article from an aluminum alloy sheet of an age-hardenable, heat-treatable aluminum alloy, the process including shaping an aluminum alloy sheet to form the shaped aluminum alloy article, heating one or more times at least a part of the shaped aluminum alloy article to a heat treatment temperature of 250 to 300° C. at a heating rate of 10 to 220° C./second, and maintaining the heat treatment temperature for 60 seconds or less. In the shaping step, the shaping may be shaping by stamping, pressing or press-forming the aluminum alloy sheet. In the above examples, the heat treatment temperature may be maintained for 5 to 30 or 10 to 15 seconds. The age-hardenable, heat-treatable aluminum alloy may be a 2xxx, 6xxx or 7xxx series aluminum alloy. The age-hardenable, heat-treatable aluminum alloy may be in T4 temper prior to the heating step and/or in T6 or T61 temper after the heating step. The yield strength of the age-hardenable, heat-treatable aluminum alloy may increase after the heating step by at least 30 to 50 MPa. The heating may be conductive heating. At least part of the shaped aluminum alloy article may be heated by application of one or more heated dies of complementary shape. The shaped aluminum alloy article may be heated as a whole or in part. For example, one or more parts of the shaped aluminum alloy article may be heated at the same or different temperatures. The exemplary process may comprise at least two heating steps at two different temperatures and/or for different time periods. For example, the process may comprise at least two heating steps at two different temperatures. The temperature of the second heating step may be lower than the temperature of the first heating step. In the above processes, the shaped aluminum alloy article may be a motor vehicle panel, although it need not be. Another example is a shaped aluminum alloy form produced by the disclosed processes, such as the exemplary processes discussed above. The shaped aluminum alloy form may be a motor vehicle panel, such as an automotive panel or any other suitable product. Yet another non-limiting example is the use of the automotive panel for fabrication of a motor vehicle body.

DESCRIPTION

Figure 1:
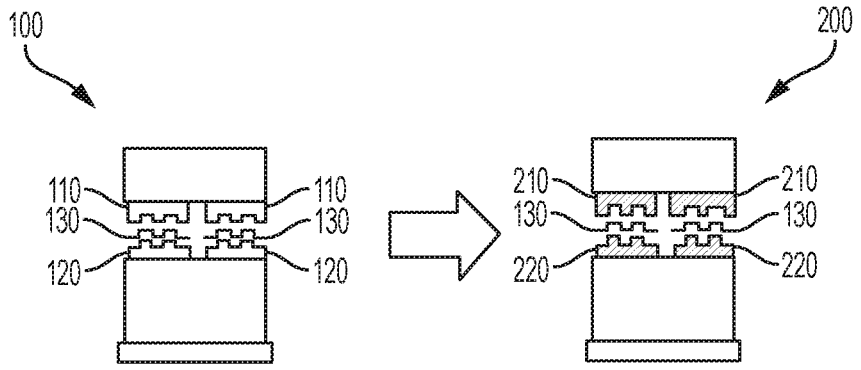
FIG. 1 is a schematic illustration of a process of stamping and heat treating an aluminum sheet.

Disclosed are processes for improving the strength of heat-treatable, age hardenable aluminum alloys, such as 2xxx, 6xxx and 7xxx aluminum alloys often used for production of automotive panels. The processes for improving the strength of heat-treatable, age hardenable aluminum alloys involve a heat treatment step, termed "shock heat treatment," which involves heat treatment at 200 to 350° C. that is conducted at a fast heating rate (for example, 10 to 220° C./second) for a short period of time (for example, for 60 seconds or less, for 5 to 30 seconds or for 5 to 15 seconds). Shock heat treatment processes disclosed herein improve the strength of heat-treatable aluminum alloys by employing shorter heating times and faster heating rates, in comparison to the conventional heat treatment processes, such as PFHT, commonly employed in the automotive industry. In some examples, shock heat treatment is accomplished by contact heating an aluminum alloy article between heated dies of a press, although other heating processes can be employed, as discussed further in more detail.

Due to the short heating times employed, shock heat treatment according to some examples can be advantageously incorporated in the production lines and processes employed in automotive industry for manufacturing of aluminum automotive parts, such as automotive body panels. The disclosed shock heat treatment processes are not limited to the automotive industry, or more generally the motor vehicle industry, and can be employed in other industries that involve fabrication of aluminum articles. In one example, a shaped aluminum alloy article (or a part thereof) is produced from an age-hardenable, heat-treatable aluminum alloy, such as 2xxx, 6xxx or 7xxx series aluminum alloy, and is subsequently heated one or more times to a temperature of 250 to 350° C. for 60 seconds or less. In another example, a process involves shaping the article from an aluminum alloy sheet of an age-hardenable, heat-treatable aluminum alloy, for example, by stamping, pressing or press-forming the aluminum alloy sheet, and subsequently heating the article one or more times to 250 to 350° C. for 60 seconds or less. Shock heat treatment is discussed in more detail below.

Shock Heat Treatment

Processes according to examples involve applying one or more shock heat treatment steps to an aluminum alloy article. Shock heat treatment according to examples disclosed herein is a heat treatment conducted according to characteristic parameters, such as temperature, duration or heating rate, which can be used to describe the shock heat treatment step or steps. One of the characteristic parameters is a length of time during which the aluminum alloy article is held at an elevated temperature (i.e., soaking time), which can be, but is not limited to, 2 seconds to 10 minutes, 60 seconds or less, 2 to 120 seconds, 2 to 60 seconds, 2 to 30 seconds, 2 to 20 seconds, 2 to 15 seconds, 2 to 10 seconds, 2 to 5 seconds, 5 to 120 seconds, 5 to 60 seconds, 5 to 30 seconds, 5 to 20 seconds, 5 to 30 seconds, 5 to 15 seconds, 5 to 10 seconds, 10 to 120 seconds, 10 to 60 seconds, 10 to 30 seconds, 10 to 20 seconds or 10 to 15 seconds. Some of the exemplary shock heat treatment soaking times are about 5, 10, 15, 20, 25, 30, 35, 40, 45, 50, 55 seconds, 1 minute (60 seconds) or 2 minutes (120 seconds). More than one shock heat treatment step may be employed in a shock heat treatment process. For example, in some cases, 2 to 5 shock heat treatment steps of 5 seconds each may be conducted, resulting in a cumulative shock heat treatment time of 10 to 25 seconds. Each of the multiple heat treatment steps may be conducted for one of the durations specified above; different durations may be employed for different steps. In some instances, the cumulative or combined length of the multiple shock heat treatment steps may be longer than the maximum soaking times specified above. Conducting a heat treatment step over a relatively short time period, such as 5 to 30 seconds, allows for efficient incorporation of the heat treatment step into certain fabrication processes and production lines, such as an automotive panel manufacturing line, without major disruption of such lines and processes. Shock heat treatment as disclosed herein can improve the mechanical characteristics of an aluminum alloy that are at least comparable to the improvements achieved by other heat treatment methods employing longer soaking times.

Shorter soaking times for shock heat treatment can be achieved by choosing the temperature of the shock heat treatment so that the desired changes in the mechanical characteristics of an age hardenable aluminum alloy are modulated within a relatively short time period. The mechanical properties of an aluminum alloy achieved by employing shock heat treatment according to the methods disclosed herein can be tailored by changing the temperature, time or both of the shock heat treatment. Shock heat treatment as described herein employs the exemplary temperatures of 200 to 350° C., 200 to 325° C., 200 to 320° C., 200 to 310° C., 200 to 270° C., 250 to 350° C., 250 to 325° C., 250 to 320° C., 250 to 310° C. or 250 to 270° C. For example, shock heat treatment may be conducted at 250° C., 255° C., 260° C., 265° C., 270° C., 275° C., 280° C., 285° C., 290° C., 295° C., 300° C., 305° C., 310° C., 315° C., 320° C. or 325° C. By changing the temperature of shock heat treatment, one can modulate the mechanical characteristics, such as yield strength, of the resulting aluminum alloy or aluminum alloy article and/or the rate at which these mechanical characteristics are achieved. For example, increasing the temperature of the shock heat treatment within the suitable range may lead to faster hardening of the aluminum alloy, characterized by a quicker rate yield strength increase. Thus, the beneficial increase in yield strength of an aluminum alloy may be achieved in a shorter time. Higher soaking temperature can be employed to achieve more favorable kinetics of yield strength increase during shock heat treatment. At the same time, increased temperature of the shock heat treatment may lead to lower peak yield strength, which should be taken into account when choosing shock heat treatment temperature. Employing a combination of two or more heat treatment steps conducted at different shock heat treatment temperatures, as discussed in more detail below, is one approach to achieving suitable mechanical characteristics of an aluminum alloy or an article made from the aluminum alloy. The choice of the temperature or temperatures for one or more of the shock heat treatment steps also depends on the nature of an aluminum alloy, for example, its composition and treatment (which may be characterized by temper) prior to shock heat treatment.

Shock heat treatment according to one example employs a heating rate of 10 to 200° C./second, for example, 10 to 100° C./second, 10 to 50° C./second, 10 to 20° C./second. The heating rate can be achieved by choosing an appropriate heating process or system to heat an aluminum alloy article. Generally, the heating process or system employed in shock heat treatment should deliver sufficient energy to achieve the above-specified heating rates. For example, devices and processes for thermal conduction heating can be used to achieve a fast heating rate suitable for the disclosed shock heat treatment. One example of such a process is contact heating of an aluminum alloy by heated tools of a complementary shape. For example, for shock heat treatment, an aluminum alloy article can be treated by applying to the aluminum alloy article one or more heated dies of a press having a complementary shape, as illustrated in FIG. 1. FIG. 1 is a schematic illustration of a process of stamping and heat treating an aluminum sheet. FIG. 1 shows a stamping press 100 having two top dies 110 and two bottom dies 120 and shaped articles 130 formed by compression between the top dies 110 and bottom dies 120. FIG. 1 further shows shaped articles 130 formed by the stamping press 100 placed in a heating press 200 having heated top dies 210 and heated bottom dies 220. The heated top dies 210 and bottom dies 220 are shaped such that they contact the surface of the shaped article 130 without the dies 210, 220 changing the shape of the shaped article 130. More generally, contact heating can be accomplished by any contact with a heated object, substance, or body. Application of heated tools is one example. Another example of a contact heating process is immersion heating, which may involve immersing an aluminum alloy article in a heated liquid ("heated bath"). Shock heat treatment can also be accomplished by non-contact heating processes, for example, by radiation heating. Some non-limiting examples of heating processes that can be employed are hot air heating, contact heating, heating by induction, resistance heating, infrared radiation heating, and heating by gas burner. For example, a contact heating tool or tools of a suitable size and shape may be applied to a part or parts of an aluminum alloy article in order to achieve local heating of the article's part or parts. In other examples, a contact heating tool, such as a die of a heated press, may be applied to a whole article, or a heated bath may be employed to achieve heating of the whole article. In one more example, shock heat treatment may be performed only on a formed part of a previously stamped aluminum article, but not to its flange area, to maintain bending/hemming capability of the flange. Thus, for tailored shock heat treatment, design and optimization of the heating system and protocol may be used to manage heat flow and/or to achieve the desired characteristics of the treated article.

Shock heat treatment of an aluminum alloy article affects one or more of the mechanical properties of the aluminum alloy. The mechanical characteristics of an aluminum alloy improved by the disclosed shock heat treatment can be one or more strength characteristics, such as yield strength, maximum tensile strength, and/or elongation. In some examples, the strength of the age-hardenable, heat-treatable aluminum alloy is increased by one or more shock heat treatment steps. For example, yield strength of an aluminum alloy sample measured as 0.2% offset yield strength ($R_{p0.2}$) may be increased by at least 30 to 50 MPa, for example, by 30 to 150 MPa or by 30 to 85 MPa. Different mechanical properties of an aluminum alloy may be affected in different ways. For example, shock heat treatment under particular conditions may achieve improvements in $R_{p0.2}$ of an aluminum alloy comparable with those achieved by heat treatment processes conducted for longer time periods, but the maximum tensile strength ($R_m$) and/or elongation achieved under these conditions may be lower than that achieved by the longer heat treatment processes. In another example, if shock heat treatment is performed on an aluminum article after stamping, combined effects of strain- and bake-hardening may be achieved. Shock heat treatment conditions, such as the choice of temperature or temperatures employed and the number of shock heat treatment steps, are selected so that they result in mechanical properties of an aluminum alloy suitable for a particular application. For example, shock heat treatment conditions employed in automotive panel fabrication are selected so that the resulting automotive panels possess suitable crash properties.

In some examples, more than one shock heat treatment step is employed. Two or more shock heat treatment steps conducted at two or more different temperatures, for different time periods and/or at different heated rates, can be employed to achieve desired strength characteristics of an aluminum alloy. For example, two, three, four or five shock heat treatment steps conducted at two or more different temperatures, for different time periods and/or at different heated rates may be employed. A choice of shock heat treatment conditions, such as temperature, heating rate, and/or duration, may affect the properties, such as yield strength, of an aluminum alloy subjected to shock heat treatment or an article made from such alloy. For example, combining 2 to 5 shock heat treatment steps conducted on an aluminum alloy part at 250 to 350° C. (different shock heat treatment steps may be conducted at different temperatures) for 5 seconds each results in a cumulative shock heat treatment time of 10 to 25 seconds and achieve an increase in yield strength of 30 to 150 MPa, depending on the nature of the aluminum alloy.

As discussed elsewhere in this document, higher shock heat treatment temperatures lead to faster increase in yield strength, thus allowing for shorter shock heat treatment times, but may also lead to lower maximum yield strength of the aluminum alloy subjected to shock heat treatment. Thus, a desirable combination of the aluminum alloy properties can be achieved by manipulating the shock heat treatment conditions and/or combining shot heat treatment steps. For example, a process combining one or more shock heat treatment steps conducted at a higher temperature and one or more heat treatment steps conducted at a lower temperature can lead to an alloy achieving higher yield strength in shorter time, than a process employing shock heat treatment only at one of the temperatures.

In some examples, the first shock heat treatment step is conducted at a higher temperature than the second shock heat treatment step. For example, the first step can be conducted at 300° C., while the second heat treatment step can be conducted at 250° C. In another example, different parts of a stamped aluminum alloy article can be subjected to different local shock heat treatment conditions, employing, for example, contact heating tools of different temperatures, to obtain different strength properties in different parts of the aluminum alloy article. Furthermore, as discussed in more detail below, a combination of multiple shock heat treatment steps of shorter duration, rather than one longer shock heat treatment step, may be employed for more efficient integration of the shock heat treatment process into the lines and processes for production of aluminum alloy articles. The different shock heat treatment steps can be conducted by the same or different heating methods, at the same or different heating temperature, and/or for the same or different durations of time. For example, a combination of contact heating by heating tools and heated bath treatment can be employed. In cases employing two or more heat treatment steps, these steps can be employed simultaneously (for example, when local shock heat treatment of different parts of the article is employed), sequentially, or can overlap in time.

Aluminum Alloys and Aluminum Alloy Articles

Shock heat treatment as disclosed herein can be carried out with any precipitation hardening aluminum alloy (e.g., an aluminum alloy containing Al, Mg, Si and, optionally, Cu, and capable of exhibiting an age hardening response). Aluminum alloys that can be subjected to the disclosed shock heat treatment include age hardenable aluminum alloys, such as 2xxx, 6xxx, and 7xxx series alloys. Exemplary aluminum alloys that can be subjected to the shock heat treatment may include the following constituents besides aluminum: Si: 0.4 to 1.5 wt %, Mg: 0.3 to 1.5 wt %, Cu: 0 to 1.5 wt %, Mn: 0 to 0.40 wt %, Cr: 0 to 0.30 wt %, and up to 0.15 wt % impurities. The alloys may include alternative or additional constituents, so long as the alloys are precipitation-hardening alloys.

The composition of an aluminum alloy may affect its response to shock heat treatment. For example, the increase in yield strength after heat treatment may be affected by an amount of Mg or Cu—Si—Mg precipitates present in the alloy. Suitable aluminum alloys for the shock heat treatment disclosed herein can be provided in a non-heat treated state (for example, T4 temper) or can be provided in a partially heat treated state (for example, T61 temper) and can be further heat treated according to the disclosed processes to increase their strength. The alloys may be preaged or not preaged. In some examples, the heat-treatable, age hardenable aluminum alloys subjected to the shock heat treatment are provided as an aluminum sheet in ductile T4 state or as articles formed from such sheet. The state or temper referred to as T4 refers to an aluminum alloy produced without intermediate batch annealing and pre-aging. The aluminum alloys subjected to shock heat treatment steps as disclosed herein need not be provided in T4 temper. For example, if an aluminum alloy is provided as a material that is artificially aged after stamping, then it is in T8 temper. And if the aluminum alloy is provided as a material that is artificially aged before stamping, then it is in T9 temper. Such aluminum alloy materials can be subjected to shock heat treatment according to processes disclosed herein. After shock heat treatment, the aluminum alloy sheet or the articles manufactured from such sheet are in T6 temper or partial T6 temper (T61 temper) and exhibit improvements in strength characteristics associated with such tempers. As noted above, the designation "T6 temper" means the aluminum alloy has been solution heat-treated and artificially aged to peak strength. In some other examples, the articles subjected to the shock heat treatment are initially provided in partial heat treated state (T61 temper) and are in T61 or T6 temper after shock heat treatment. Even if the temper designation of the aluminum alloy article does not change after shock heat treatment, as in the case where the article is in T61 temper before and after the shock heat treatment, shock heat treatment still changes properties of the aluminum alloy, for example, increases its yield strength.

Aluminum alloy articles suitable for shock heat treatment according to methods disclosed herein include aluminum alloy articles formed or shaped from aluminum alloy sheets. An aluminum alloy sheet can be a rolled aluminum sheet produced from aluminum alloy ingots or strips. The aluminum alloy sheet from which the aluminum alloy articles are produced is provided in a suitable temper, such as T4 or T61 temper. Formed or shaped aluminum alloy articles include two- and three-dimensionally shaped aluminum alloy articles. One example of a formed or shaped aluminum alloy article is a flat article cut from an aluminum alloy sheet without further shaping. Another example of a formed or shaped aluminum alloy article is a non-planar aluminum alloy article produced by a process that involves one or more three-dimensional shaping steps, such as bending, stamping, pressing, press-forming or drawing. Such a non-planar aluminum alloy article can be referred to as "stamped," "pressed," "press-formed," "drawn," "three dimensionally shaped" or other similar terms. An aluminum alloy article can be formed by a "cold forming" process, meaning no additional heat is applied to the article before or during forming, or by a "warm forming" process meaning the article is heated before or during forming, or the forming is conducted at elevated temperature. For example, a warm-formed aluminum alloy article can be heated to or formed at 150 to 250° C., 250 to 350° C. or 350 to 500° C.

The aluminum alloy articles provided or produced by processes described herein are included within the scope of the invention. The term "aluminum alloy article" can refer to the articles provided prior to the shock heat treatment, the articles being treated by or subjected to the shock heat treatment, as well as the articles after the shock heat treatment, including painted or coated articles. Since shock heat treatment can be advantageously employed in a motor vehicle industry, including automotive manufacturing, the aluminum alloy articles and processes of their fabrication include motor vehicle parts, such as automobile body panels. Some examples of motor vehicle parts that fall within the scope of this disclosure are floor panels, rear walls, rockers, motor hoods, fenders, roofs, door panels, B-pillars, longerons, body sides, rockers or crash members. The term "motor vehicle" and the related terms are not limited to automobiles and include but are not limited to various vehicle classes, such as, automobiles, cars, buses, motorcycles, off highway vehicles, light trucks, trucks, and lorries. Aluminum alloy articles are not limited to motor vehicle parts; other types of aluminum articles manufactured according to the processes described herein are envisioned and included. For example, shock heat treatment processes can be advantageously employed in manufacturing of various parts of mechanical and other devices or machinery, including airplanes, ships and other water vehicles, weapons, tools, bodies of electronic devices, and others.

Aluminum alloy articles disclosed herein can be comprised of or assembled from multiple parts. For example, motor vehicle parts assembled from more than one part (such as an automobile hood, including an inner and an outer panel, an automobile door, including an inner and an outer panel, or an at least partially assembled motor vehicle body including multiple panels) are included. Furthermore, such aluminum alloy articles comprised of or assembled from multiple parts may be suitable for shock heat treatment according to methods disclosed herein after they are assembled or partially assembled. Also, in some cases, aluminum alloy articles may contain non-aluminum parts or sections, such as parts or sections containing or fabricated from other metals or metal alloys (for example, steel or titanium alloys).

Processes and Systems

Processes of producing aluminum alloy articles can include one or more of the steps discussed in this document. The aluminum alloy articles are produced from an aluminum alloy sheet. In some cases, an aluminum alloy sheet may be sectioned, for example, by cutting it into precursor aluminum alloy articles or forms termed "blanks," such as "stamping blanks," meaning precursors for stamping. Accordingly, the disclosed processes may include a step or steps of producing a precursor or a blank of an aluminum alloy article. The blanks are then shaped into aluminum articles of a desirable shape by a suitable process. Non-limiting examples of the shaping processes for producing aluminum alloy articles include cutting, stamping, pressing, press-forming, drawing, or other processes that can create two- or three-dimensional shapes. For example, a process can contain a step of cutting an aluminum sheet into "stamping blanks" to be further shaped in a stamping press. A process can contain a step of shaping an aluminum alloy sheet or a blank by stamping. In the stamping or pressing process step, described generally, a blank is shaped by pressing it between two dies of complementary shape.

The processes disclosed herein include one or more steps of shock heat treatment. The processes may include shock heat treatment as a stand-alone step or in combination with other steps. For example, the process can include a step of shaping an aluminum alloy article and one or more steps of heat treating the shaped aluminum alloy article according to the characteristic parameters (temperature, heating time and/or heating rate) of shock heat treatment. The processes can incorporate shock heat treatment into the existing processes and lines for production of aluminum alloy articles, such as stamped aluminum articles (for example, stamped aluminum alloy automotive panels), thereby improving the processes and the resulting articles in a streamlined and economical manner. The apparatuses and the systems for performing the processes and producing the articles described in this document are included within the scope of the invention.

An example is a process for producing a stamped aluminum alloy article, such as a motor vehicle panel, which includes several (two or more, such as two, three, four, five, six or more) steps of stamping the article on a sequence of stamping presses ("press line"). The stamping steps are the so-called "cold forming" steps, meaning no additional heating of an article is performed. A stamping blank is provided before the first stamping step. The process includes one or more shock heat treatment steps conducted at different process points with respect to one or more of the stamping steps. At least one of the shock heat treatment steps may be conducted on a stamping blank before the first stamping step (that is, at the entry of the press line). In this case, the blank, which may be provided in T4 temper, may be converted into T6 or T61 temper after the above shock heat treatment step and before the first pressing step. At least one shock heat treatment step may be performed after the last stamping step (that is, at the end of the press line). In this case, the stamped article may be converted into full T6 temper by the shock heat treatment step at the end of the line. Shock heat treatment steps may also be included after one or more of the first or intermediate pressing steps. For example, if the pressing line includes five stamping presses and corresponding stamping steps, such intermediate shock heat treatment steps may be included after one or more of the first, second, third and fourth intermediate stamping steps. In the case when intermediate shock heat treatment steps are included, the article may be in T4 or T61 temper before an intermediate shock heat treatment step and may be in T61 or T6 temper after the intermediate shock heat treatment step. Shock heat treatment steps may be included in a production process in various combinations. For example, when one or more of the intermediate shock heat treatment steps are employed, shock heat treatment steps may also be included at the beginning and at the end of the press line, as discussed above. Various considerations may be taken into account when deciding on a specific combination and placement of shock heat treatment steps in a production process. For example, if a shock heat treatment step or steps are introduced prior to a stamping step or steps, forming by stamping may become more difficult, but it is possible for the resulting article to retain higher strength characteristics, in comparison to other configurations of the production line.

The decisions on the duration and other parameters of the shock heat treatment steps, on the number and the integration points of the shock heat treatment steps and the corresponding stations to be included into the fabrication processes or systems are made based on various considerations. For example, as discussed earlier, a desirable combination of aluminum alloy properties can be achieved by manipulating the shock heat treatment conditions. Accordingly, the decision on the number of shock heat treatment steps and their parameters can be based at least in part on the desired properties of the aluminum alloy article. For example, longer shock heat treatment times may be more suitable for achieving better crash properties, which may be desirable for motor vehicle panels. Another decision-making consideration is efficient integration of the shock heat treatment steps into the manufacturing, fabrication or production process. For example, shock heat treatment steps of relatively short duration, for example, 5 to 20 seconds or 10 to 20 seconds, may be integrated without major disruption of the press line as intermediate steps conducted between the pressing steps. On the other hand, a longer (for example, 30 to 60 seconds or longer) shock heat treatment step may be more efficiently integrated as an additional step at the end of the press line. Based on the demands of the production cycle, in some cases a decision can be made in favor of multiple shock heat treatment steps of shorter duration to integrate them as intermediate steps. As discussed earlier, shock heating steps integrated into the process may be conducted at the same or different temperatures for different durations of time. For example, two or three shock heat treatment steps or stations for heat treatment at different temperatures can be integrated into a production line for motor vehicle panels. In one example, two heat treatment stations conducting shock heat treatments at 275° C. and 300° C., respectively, for 5 seconds each are included into the production line for motor vehicle panels.

Shock heat treatment may be conducted on separate, dedicated equipment (system, station, machine or apparatus). Also disclosed are systems for producing or fabricating aluminum alloy articles that incorporate equipment for shock heat treatment. One exemplary system is a press line for producing stamped aluminum alloy articles, such as aluminum alloy panels, which incorporates shock heat treatment stations or systems at various points in the line, such as in the various examples discussed above.

Shock heat treatment may be performed on assembled or partially assembled articles or parts. For example shock heat treatment may be performed on motor vehicle parts, such as hoods or doors, after they are assembled. In another example, local or partial shock heat treatment may be performed on fully or partially assembled motor vehicle bodies, for example, by application of contact heating tools to a part or parts of the body. To illustrate, the parts of the assembled or partially assembled motor vehicle body that do not achieve sufficiently high temperature during the paint bake cycle may be subjected to local shock heat treatment before or after the paint bake cycle to improve their strength. In such situations, a shock heat treatment step and corresponding station may be integrated into a production line at some point during or after assembly of a motor vehicle part or body. The choice of the point on the assembly line for integrating a shock heat treatment can be governed by various considerations. For example, a shock heat treatment can be conducted after assembly of a motor vehicle body to maintain best riveting ability of the body parts during the assembly. In another example, a shock heat treatment step can be included between any stage of the assembly of a motor vehicle body, including at a point governed by such non-limiting consideration as maintaining the riveting or the joining ability of the body parts prior to the shock heat treatment.

The processes of producing or manufacturing an aluminum article as disclosed herein can include a step of coating or painting an aluminum alloy article with suitable paint or coating. Usually, a shaped and shock heat treated aluminum alloy article is subsequently painted. For example, when the aluminum alloy article is used as an automotive or other motor vehicle panel, a body of the motor vehicle after assembly is typically coated and/or painted for corrosion protection and aesthetics. The paint and/or coatings may be applied by spraying or immersion. After application, the paint and/or coatings are typically treated in a process commonly termed "baking." Processes disclosed herein may include a paint baking step, which can be referred to as "paint baking," "paint bake," "paint bake cycle" or other related terms. Paint bake typically involves heat treatment at 160 to 200° C. for a period of up to 1 hour, for example, for 20 to 30 min. Aluminum alloy articles can undergo a paint bake cycle or a comparable heat treatment cycle even without being painted or coated. For example, an unpainted and/or uncoated automotive panel may be subjected to a paint bake cycle as a part of an assembled motor vehicle body. As discussed elsewhere in this document, a paint bake cycle may affect the aging of an aluminum alloy from which the article is manufactured and thus affect its mechanical properties, such as strength. Accordingly, a paint bake cycle or a similar heat treatment step may be employed in the processes described herein as an additional heat treatment step, meaning that a process may comprise a paint bake or a similar heat treatment step in addition to the shock heat treatment step.

Advantages

The processes described herein are suitable, among other things, for fabrication of motor vehicle aluminum alloy panels and can replace PFHT in a motor vehicle production cycle. Shock heat treatment is significantly shorter than PFHT and can be easily incorporated into the existing motor vehicle production processes and production lines. Shock heat treatment is generally applicable to heat treatment of various aluminum alloy articles, such as stamped or pressed aluminum alloy articles, to increase their strength. Shock heat treatment can advantageously replace conventional heat treatment steps employed during production of aluminum alloy articles to increase their strength, or can be used in addition to conventional heat treatment steps. The advantage of replacing a conventional heat treatment step, such as PFHT, with the shock heat treatment process as disclosed herein is that the shock heat treatment process can be one or more of: energy efficient due to the shorter heat treatment time; less time consuming; and/or easily incorporated into an existing production process, for example, incorporated into an existing press line at production rate of the press line. An advantage of such integration is that the press line can then produce the stamped or pressed aluminum alloy articles, such as motor vehicle panels, in T6 or T61 temper, which can enter the next process step after the press line. Processes of shock heat treatment disclosed herein are also highly customizable, resulting in improved flexibility of the production processes. For example, a shock heat treatment step can be easily and efficiently integrated into a motor vehicle production cycle to produce desired characteristics of the article being produced, depending on demand.

The processes described herein increase the strength of the aluminum alloy articles subjected to shock heat treatment. In turn, the increased strength may allow for decreasing the thickness (down gauging) of the aluminum articles, such as automotive panels, thus decreasing their weight and material costs. Furthermore, improved strength characteristics of aluminum alloys achieved by the disclosed shock heat treatment can widen the use of aluminum alloys in various industries, such as the motor vehicle industry, particularly the automotive industry.

The following examples will serve to further illustrate the invention without, at the same time, however, constituting any limitation thereof. On the contrary, resort may be had to various embodiments, modifications and equivalents thereof which, after reading the description herein, may suggest themselves to those skilled in the art without departing from the spirit of the invention.

EXAMPLES

In the following examples, sheets of aluminum alloy AA6451 and sheets of an experimental alloy composition (referred to as "Alloy A" in this document) were produced in T4 temper and in T4 temper with 2% pre-strain to imitate post-stamping conditions. Alloy A had a composition of 0.95 to 1.05 wt % Si, 0.14 to 0.25 wt % Fe, 0.046 to 0.1 wt % Mn, 0.95 to 1.05 wt % Mg, 0.130 to 0.170 wt % Cr, 0 to 0.034 wt % Ni, 0 to 0.1 wt % Zn and 0.012 to 0.028 Ti, remainder Al and impurities. The samples were heat treated by a salt bath procedure and/or a hot press, or platen press, procedure. For the salt bath procedure, the samples were heated by immersion into a salt bath oven containing a molten salt mixture of alkaline nitrates at a stable temperature. In the following examples, for the hot press procedure a Collin® press was used. The press was heated to a stable temperature, the samples were placed between two plates of the press, and pressure was applied. The pressure ensured very fast heating of the sample.

Example 1

Comparison of Heat Treating Methods

Figure 2:
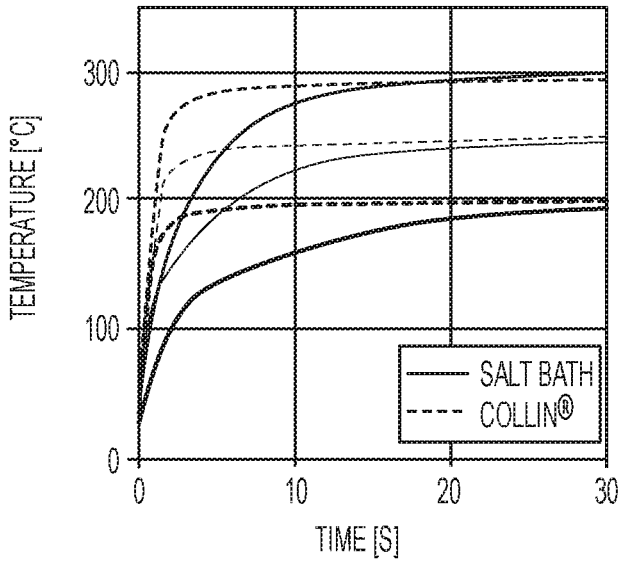
FIG. 2 is a graph of temperature as a function of time for samples of alloy AA6451 subjected to heat treatment by salt bath immersion (solid lines) or Collin® hot press (dashed lines).

To compare the salt bath and hot press heating methods used in some of the following examples, samples of AA6451 were heated by the salt bath procedure and by the hot press procedure. Data were collected with the salt bath and the hot press each at 200° C., 250° C., and 300° C. Both heat treatment procedures ensured fast heating of samples, as illustrated in FIG. 2. The solid lines in FIG. 2 demonstrate the temperature of the sample heated by the salt bath procedure, and the dashed lines demonstrate the temperature of the sample heated by the hot press procedure. The time required to achieve the target heat treatment temperature was approximately 15 seconds for the salt bath procedure and approximately 5 seconds for the stamping procedure, as illustrated in FIG. 2.

Figure 3:
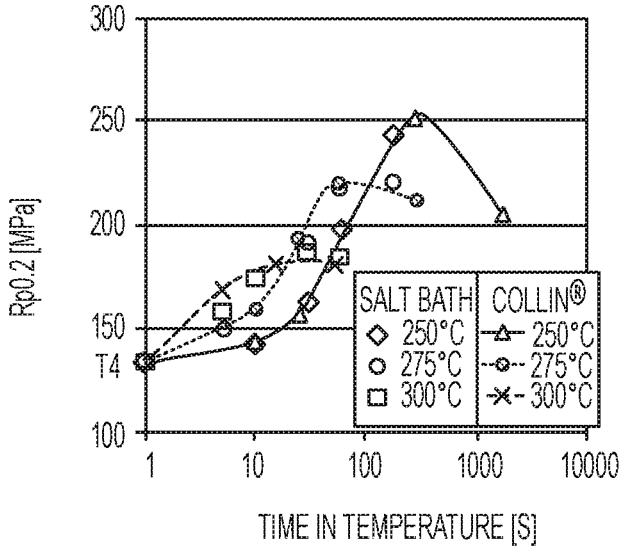
FIG. 3 is a graph of $R_{p0.2}$ as a function of time for samples of alloy AA6451 subjected to heat treatment by salt bath immersion and in a Collin® press.

The salt bath and hot press procedures provided comparable hardening of the alloy samples. The 0.2% offset yield strength ($R_{p0.2}$) of the samples was measured to monitor the hardening process at temperatures of 250° C., 275° C. and 300° C. for each heat treatment process, as illustrated in FIG. 3. The x-axis represents time the alloy is held at the specified temperature. Heating time to the specified temperature is not included, but it can be deduced from the data represented in FIG. 2 as 15 seconds for the salt bath immersion and 5 seconds for the hot press. FIG. 3 demonstrates that nearly identical alloy hardening is expected using the salt bath and the hot press procedures. Therefore, in the following examples, while only one procedure was used at each temperature, the results are exemplary of heating at that temperature generally, irrespective of the heating method used.

Example 2

Yield Strength Achieved at Various Temperatures

Peak yield strength was determined at various temperatures by subjecting samples of AA6451 and samples of Alloy A to heat treatment at various temperatures in the 200 to 350° C. heat treatment temperature range and measuring the 2% offset yield strength, $R_{p2.0}$. FIGS. 4 and 5 show that for both alloy AA6451 and Alloy A, while peak $R_{p0.2}$ was reached faster at higher temperatures, the increase of the heat treatment temperature from 200° C. to 350° C. caused a decrease in peak $R_{p0.2}$ for alloy AA6451 and Alloy A. The alloy samples were subjected to heat treatment by salt bath immersion for the temperatures above 300° C. and in a Collin® press for the temperatures of 300° C. and below. The difference in heating procedure at the different temperatures was a result of limitations of the available equipment, and should not affect the results, as Example 1 demonstrated that similar hardening is achieved by the two heating methods. In FIGS. 4 and 5, the x-axis represents the time the alloy is held at the specified temperature, not including the heating time.

Figure 4A:
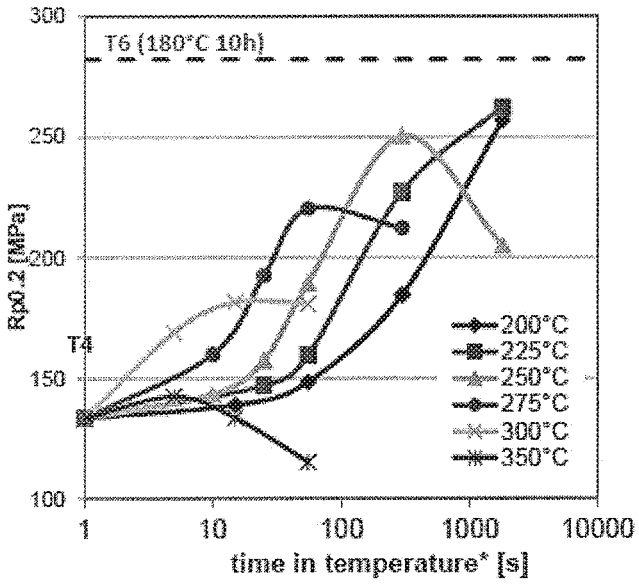
FIGS. 4A-B are graphs of $R_{p0.2}$ as a function of time for samples of alloy AA6451 subjected to heat treatment by salt bath immersion (the temperatures above 300° C.) or in a Collin® press (the temperatures of 300° C. and below).

FIG. 4A illustrates the experimental results for alloy AA6451 in T4 temper subjected to heat treatment at various temperatures. The horizontal dashed line in panel A is a reference line indicating $R_{p0.2}$ achieved for the same alloy sample in T6 temper after heat treatment at 180° C. for 10 hours.

Figure 4B:
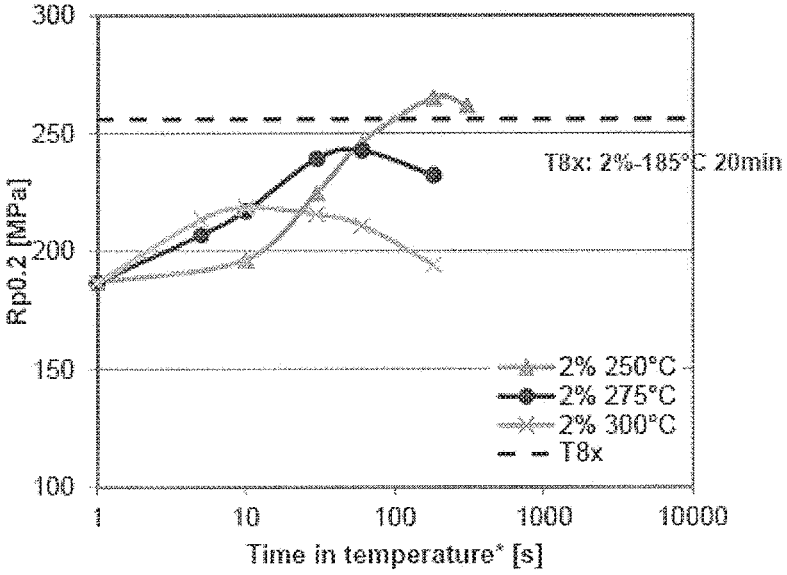

FIG. 4B illustrates the experimental results for alloy AA6451 in T4 temper with 2% pre-strain subjected to heat treatment at various temperatures. The horizontal dashed line in panel B is a reference line indicating $R_{p0.2}$ achieved for the same pre-strained T4 alloy sample after a heat treatment of 185° C. for 20 min to put the alloy in T8X temper. As shown in FIG. 4B, for the AA6451 sample in T4 temper with 2% pre-strain, heat treatment for about 1 minute (total time in press) at 275° C. led to $R_{p0.2}$ of about 240 MPa, which is close to $R_{p0.2}$ typically achieved during the simulated bake hardening process (heating at 185° C. for 20 minutes) for the same alloy. Thus using a shock T6 process, a part formed from this alloy that would not see a standard paint bake, such as an inner part that is shielded by outer parts during paint bake, could reach the same strength as the paint baked parts from this alloy.

Figure 5A:
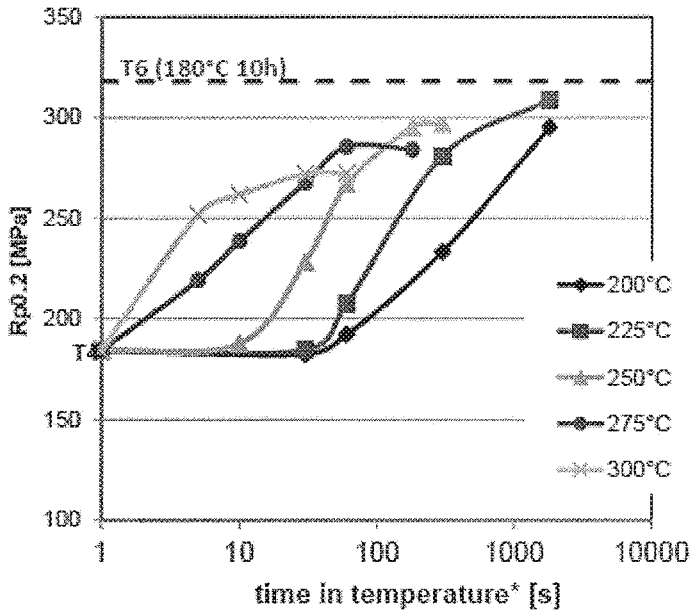
FIGS. 5A-B are graphs of $R_{p0.2}$ as a function of time for samples of an experimental alloy subjected to heat treatment in a Collin® press at various temperatures and for various time periods.

FIG. 5A illustrates the experimental results for Alloy A in T4 temper subjected to heat treatment at various temperatures. The horizontal dashed line in panel A is a reference line indicating $R_{p0.2}$ achieved for the same alloy sample in T6 temper after heat treatment at 180° C. for 10 hours.

Figure 5B:
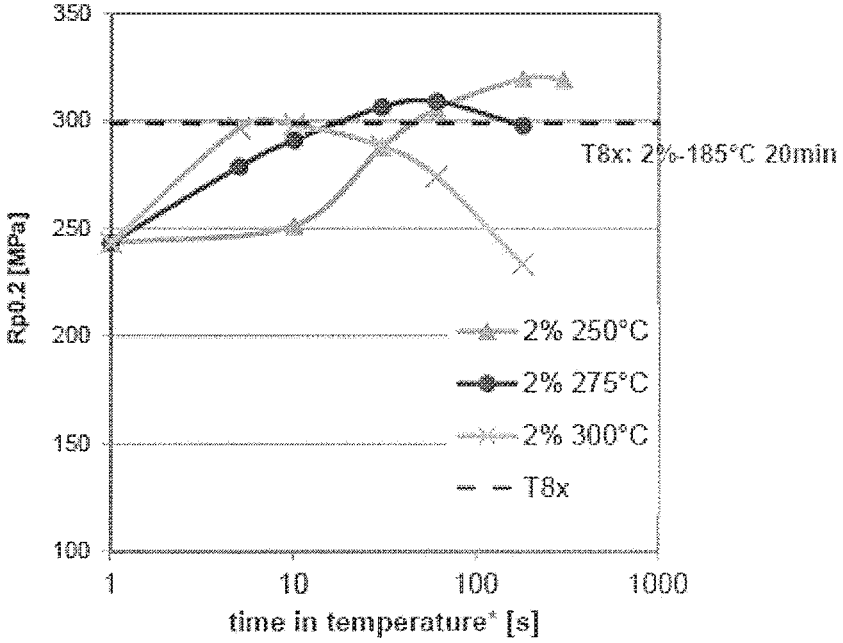

FIG. 5B illustrates the experimental results for Alloy A in T4 temper with 2% pre-strain subjected to heat treatment at various temperatures. The horizontal dashed line in panel B is a reference line indicating $R_{p0.2}$ achieved for the same pre-strained T4 alloy sample after a heat treatment of 185° C. for 20 min to put the alloy in T8X temper. As shown in FIG. 5B, for the Alloy A sample in T4 temper with 2% pre-strain, heat treatment for 10 to 15 seconds (total time in press) at 300° C. led to $R_{p0.2}$ of 300 MPa, which corresponds to $R_{p0.2}$ typically achieved during the simulated bake hardening process (heating at 185° C. for 20 minutes) for the same alloy. Thus using a shock T6 process, a part formed from this alloy that would not see a standard paint bake, such as an inner part that is shielded by outer parts during paint bake, could reach the same strength as the paint baked parts from this alloy.

Some of the $R_{p0.2}$ increases achieved during the testing of heat treatment conditions are shown in Table 1.

TABLE 1

$R_{p0.2}$ increases achieved during the testing of heat treatment conditions

| Alloy | Conditions | $R_{p0.2}$ increase |
|---|---|---|
| AA6451, | 250° C., 30 seconds | 30 MPa |
| without | 275° C., 30 seconds | 59 MPa |
| pre-strain | 300° C., 10 seconds | 41 MPa |
| AA6451, | 250° C. 30 seconds | 38 MPa |
| with 2% | 275° C., 10 seconds | 30 MPa |
| pre-strain | 300° C., 10 seconds | 31 MPa |
| Alloy A, | 250° C., 30 seconds | 44 MPa |
| without | 275° C., 5 seconds | 35 MPa |
| pre-strain | 275° C., 10 seconds | 54 MPa |
| | 300° C., 5 seconds | 67 MPa |
| Alloy A, | 250° C. 30 seconds | 44 MPa |
| with 2% | 275° C., 5 seconds | 35 MPa |
| pre-strain | 300° C., 5 seconds | 53 MPa |

Example 3

Combination Heat Treatment of Aluminum Alloy Samples

Figure 6:
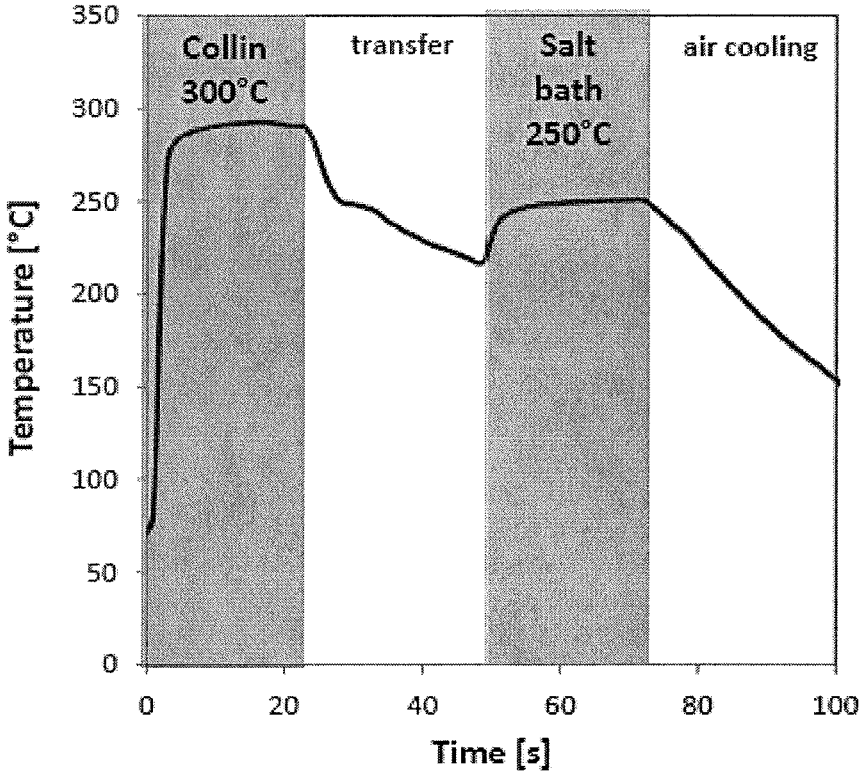
FIG. 6 is an illustrative two-step heat-treatment process conducted on a sample of alloy AA6451, the process including heat treatment in a Collin® press and subsequent salt bath immersion heat treatment.

Samples of sheets of AA6451 and Alloy A were subjected to a two-step heat treatment process, which included a Collin® press heat treatment procedure (10 or 30 seconds at 300° C.) and a salt bath procedure (various times at 250° C.), followed by air cooling. An exemplary two-step treatment process is illustrated in FIG. 6, which is a graph of alloy sheet temperature as a function of time for a process of heating a sample of AA6451 including heat treatment by Collin® press at 300° C. for 30 seconds, transfer to a salt bath, and heat treatment by salt bath at 250° C. for 20 seconds.

Figure 7A:
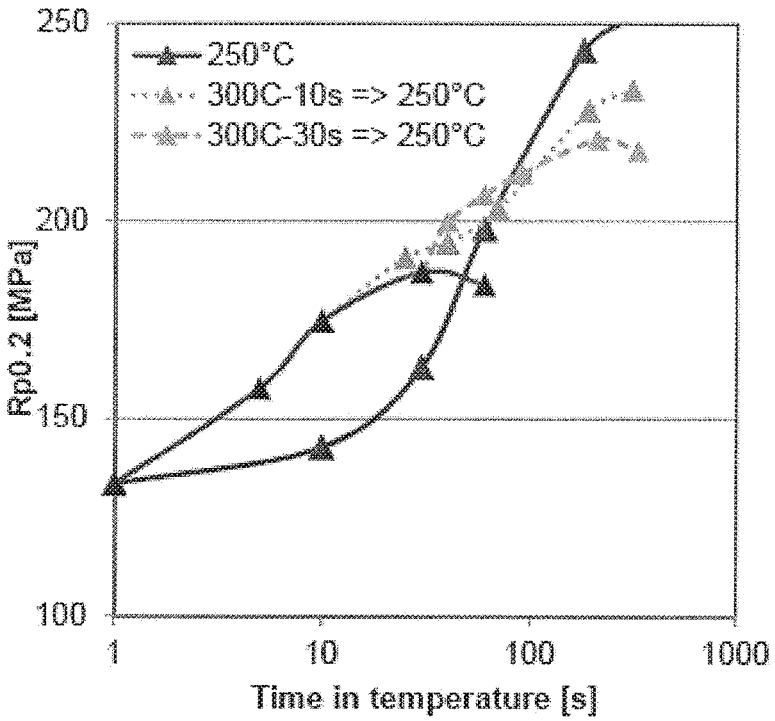
FIGS. 7A-B are graphs of $R_{p0.2}$ as a function of time for samples of alloy AA6451 (panel A) and of an experimental alloy (panel B) subjected to various heat treatment processes.
Figure 7B:
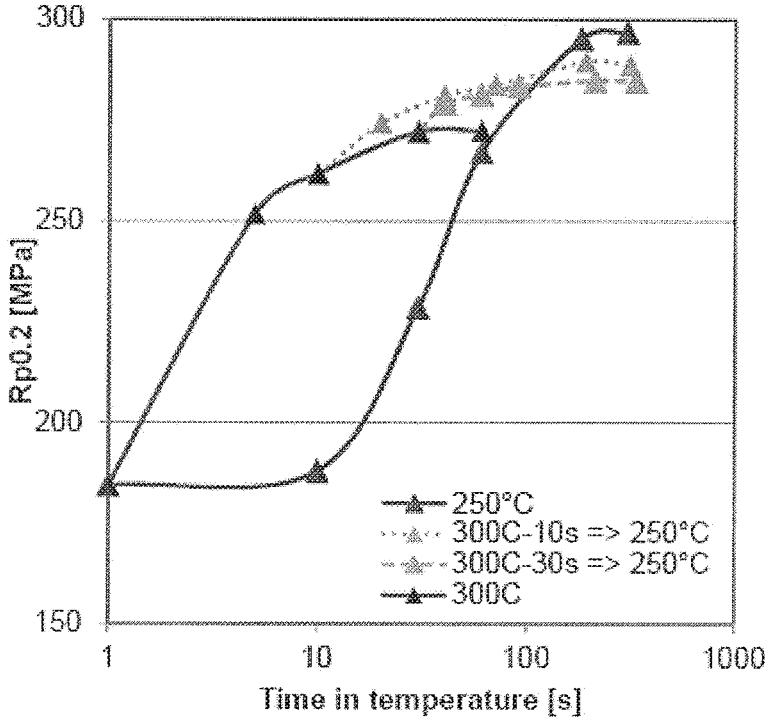
Figure 8A:
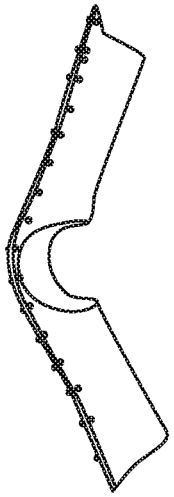
FIGS. 8A-D are illustrations of crash tubes of an alloy treated by shock heat treatment (panels A and B) and an alloy in T4 temper (panels C and D) after a horizontal crash test.
Figure 8B:
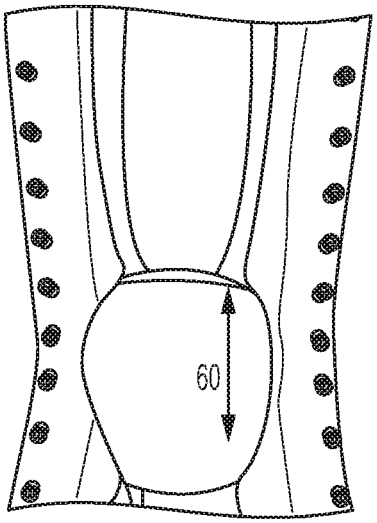
Figure 8C:
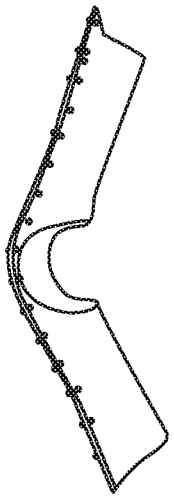
Figure 8D:
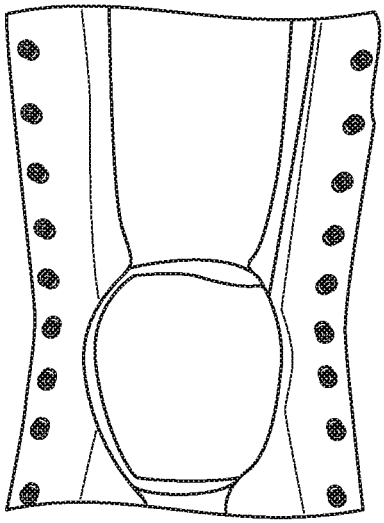

Samples of AA6451 and samples of Alloy A were subjected to various one-step or two-step heat treatments. Samples of the alloys were heated in a one-step heat treatment in a salt bath at 250° C.; a two-step heat treatment including Collin® press treatment at 300° C. for 10 seconds, followed by salt bath treatment at 250° C.; a two-step heat treatment including Collin® press treatment at 300° C. for either 10 seconds or 30 seconds, followed by salt bath treatment at 250° C.; or a one-step heat treatment in a Collin® press at 300° C. The x-axis represents the time the alloy sample was held at each temperature, not including the heating time. As shown in FIG. 7, for both AA6451 and Alloy A, higher $R_{p0.2}$ values were achieved by both of the two-step processes than by the one-step process at 300° C. $R_{p0.2}$ increased much more quickly during the initial heating step (at 300° C.) of the two step processes and for the one-step process at 300° C. than during the same time period for the one-step process at 205° C. But, $R_{p0.2}$ increased more quickly during both of the two-step processes after switching to the second heating step at 250° C. than it did over the same time period during the one-step procedure at 300° C.

Example 4

Crash Tests for Shock Heat Treated Alloys

Crashability of an alloy sample treated by methods disclosed herein was compared to a non-heat treated (i.e., T4 temper) sample of the same alloy. This alloy sample had a composition of Si 1.0, Fe 0.2, Cu 1.0, Mg 1.0, Mn 0.08, Cr 0.14 all in wt %, up to 0.15 wt % impurities, with the remainder aluminum, and is referred to herein as "Alloy B."

A sheet (2 mm thick) of Alloy B was heated in an oven at 500° C. for 90 s (not including time to raise the sheet to 500° C.) to place the sheet in "Shock T6" temper. The sheet was then folded and bolted to form a crash tube. A second crash tube was formed from a sheet (2 mm thick) of Alloy B in T4 temper. The tubes were tested in a quasistatic 3-point bend setup (horizontal crash test).

Figure 9A:
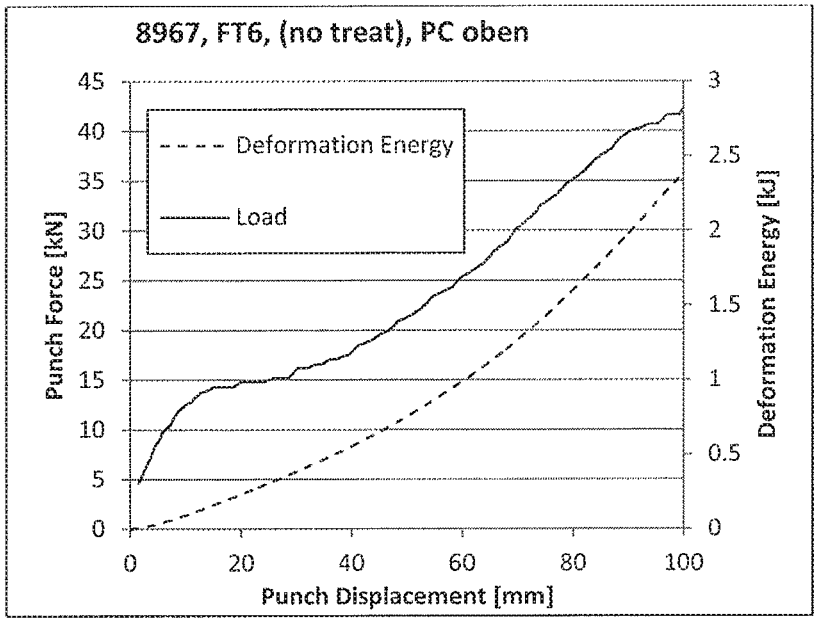
FIGS. 9A-B are graphs of deformation energy and load as functions of displacement for the alloys in the horizontal crash test.
Figure 9B:
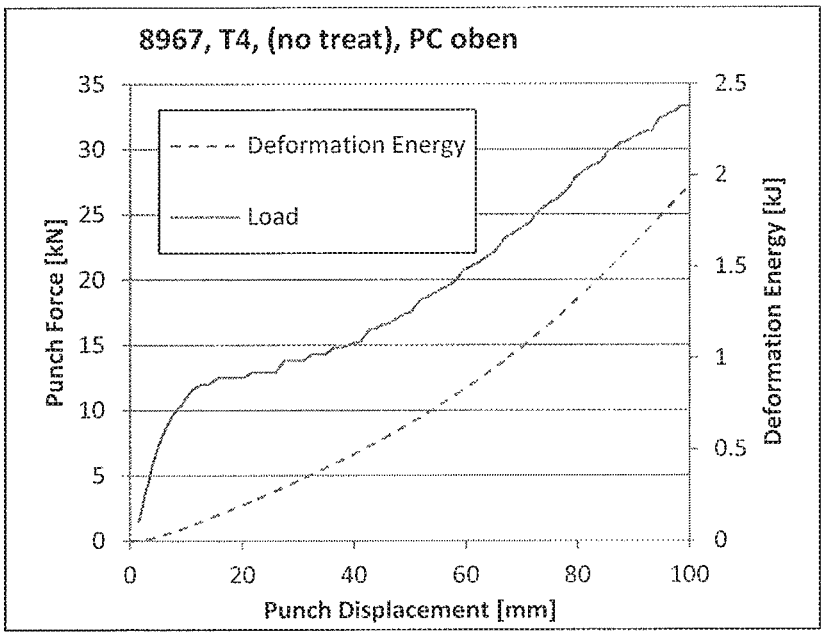
Figure 10A:
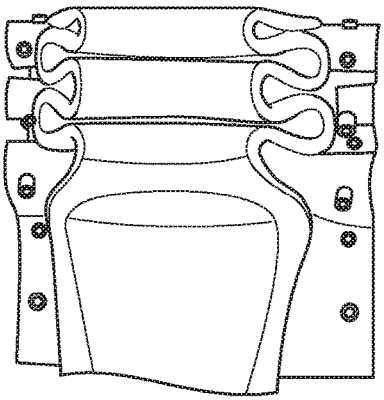
FIGS. 10A-D are illustrations of crash tubes of an alloy treated by shock heat treatment (panels A and B) and an alloy treated with conventional heat treatment (panels C and D) after a vertical crash test.
Figure 10B:
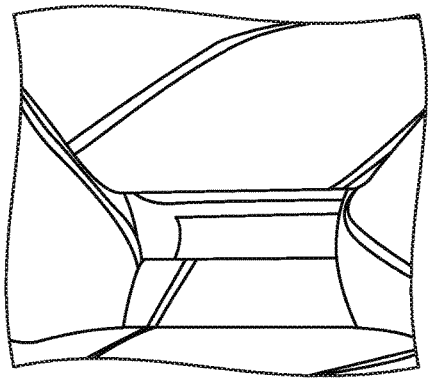
Figure 10C:
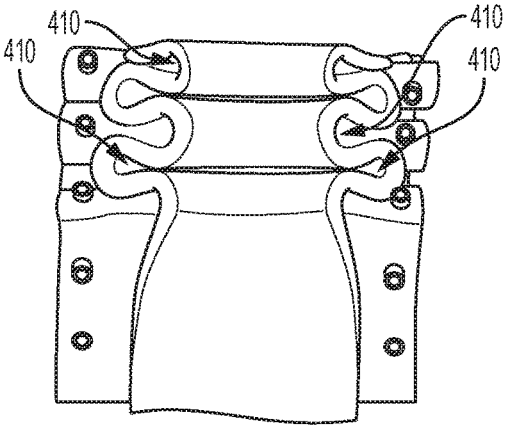
Figure 10D:
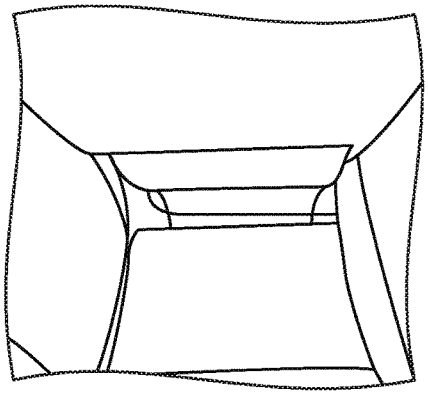

FIG. 8 shows illustrations of the crash test tubes after the horizontal crash tests. FIGS. 8A and 8B show the Shock T6 Alloy B. FIGS. 8C and 8D show the T4 Alloy B. As shown in FIG. 8, both tubes passed the test. FIG. 9 illustrates applied punch force (kN) and deformation energy (kJ) as functions of punch displacement (mm) for the horizontal crash tests. FIG. 9A is a graph of force and deformation energy as functions of displacement for Alloy B in Shock T6 temper, and FIG. 9B is a graph of force and deformation energy as functions of displacement for Alloy B in T4 temper. As shown in FIG. 9, the Shock T6 temper alloy absorbed 26% more energy than the T4 temper alloy (2.4 kJ as compared to 1.9 kJ).

These tests indicate that the materials treated by the methods disclosed herein have good crashability. The materials treated by methods disclosed herein absorb more energy during a crash compared to a T4 material, but not quite as much as a standard T6 material.

Crashability of an aluminum alloy sample treated by methods disclosed herein and a sample of the same alloy treated by standard heat treatment were also compared. The alloy had a composition of 0.91 Si, 0.21 Fe, 0.08 Cu, 0.14 Mn, 0.68 Mg, 0.04 Cr, and 0.030 Ti, all in wt %, up to 0.15 wt % impurities, with the remainder aluminum, and is referred to herein as "Alloy C."

A sheet (2.5 mm thick) of Alloy C in T4 temper was heated by shock heat treatment in a salt bath at 275° C. for 1 minute (not including 25 seconds to raise the sheet to 275° C.) to place the sheet in "Shock T6" temper. The sheet was then folded and bolted to form a crash tube. A second crash tube was formed from a sheet (2.5 mm thick) of Alloy C in T4 temper. After forming, the tube was heated at 180° C. for 25 min to place the tube in T62 temper as defined by ISO2107. The additional heating conditions were chosen to give the T62 tube the same $R_{p0.2}$ as the Shock T6 tube, i.e., about 200 MPa. The tubes were tested in vertical compression at a constant quasistatic speed in a press (vertical crash tests).

Figure 11:
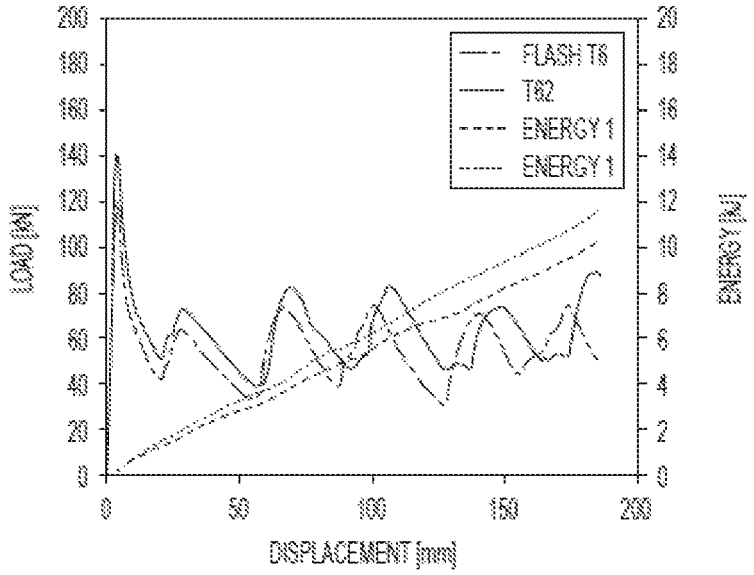
FIG. 11 is a graph of load and energy as functions of displacement for the alloys in the vertical crash test.

FIG. 10 shows illustrations of the crash test tubes after the vertical crash tests. FIGS. 10A and 10C show side views of the crash tubes after testing, and FIGS. 10B and 10D show bottom views of the crash tubes after testing. FIGS. 10A and 10B show the Alloy C Shock T6 tubes after testing. FIGS. 10C and 10D show the Alloy C T62 tubes after testing. The crash tubes in Shock T6 successfully folded upon crushing with no tearing or cracks in the vertical crash test, whereas the reference crash tubes exhibited some surface cracks in the areas 410 identified on FIG. 10C. Load and energy were measured as functions of displacement of the alloy material. FIG. 11 is a graph of load and energy as functions of displacement for the Shock T6 and T62 materials illustrating that the Shock T6 tube absorbed less energy during the crash test.

Figure 12:
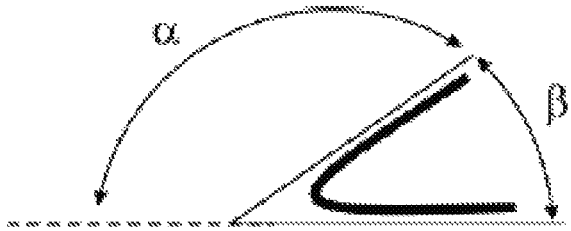
FIG. 12 is a schematic of a bending performance test.

As compared to conventional heat treatment, shock heat treatment resulted in an alloy with a lower ultimate tensile strength, as measured by ISO 6892-1 but slightly better bending performance as measured by ISO 7438 (general bending standard) and VDA 238-100 for similar $R_{p0.2}$. FIG. 12 is a schematic of a bending performance test performed according to VDA 238-100. Table 4 summarizes the results of the tests.

TABLE 4

| | Shock T6 | T62 |
|---|---|---|
| $R_p/R_m$ [MPa] | 200/204 | 198/281 |
| DC (alpha) [°] | 115 | 107 |
| Crash ranking | perfect | good |
| Crash Energy [kJ] | 10.4 | 11.7 |

Example 5

Shock Heat Treatment Using Hot Air

Shock heat treatment with hot air can provide similar hardening to shock heat treatment with a hot press. Samples of Alloy A were heated using a Collin® press heated to 250° C., 275° C., or 300° C. or using hot air at 350° C., 400° C., or 500° C.

Figure 13:
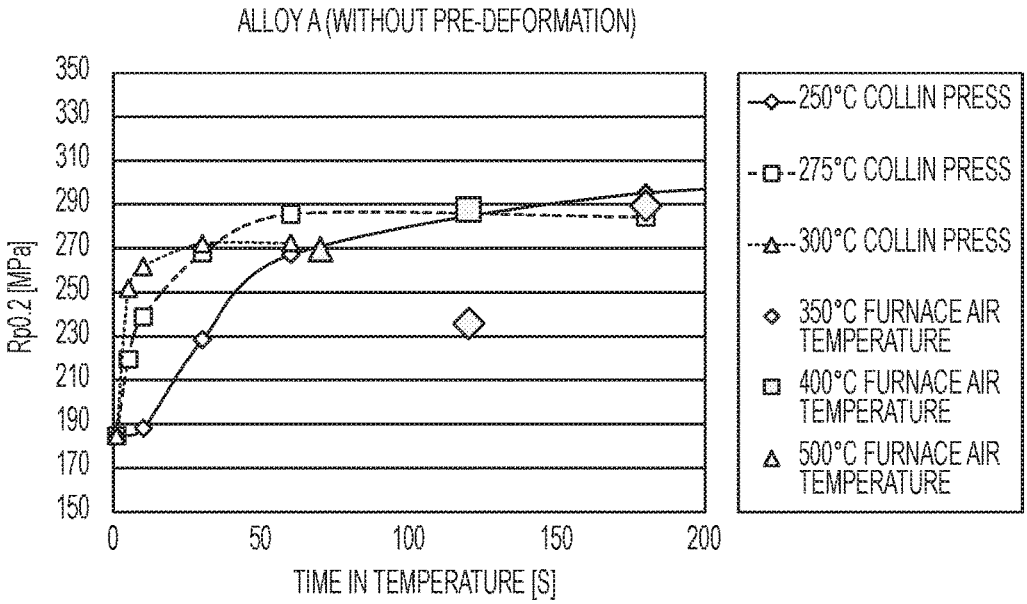
FIG. 13 is a graph of $R_{p0.2}$ as a function of time for alloys treated at different temperatures in a Collin® press or at different temperatures by hot air.

FIG. 13 is a graph showing increase in $R_{p0.2}$ as a function of time for the samples heated using the different heating methods. $R_{p0.2}$ increased more quickly with the hot press method, but similar maximum $R_{p0.2}$'s were reached using the hot air method in as little as about 120 seconds.

Example 6

Shock Heat Treatment on Preaged Vs. Non-Preaged Materials

Figure 14A:
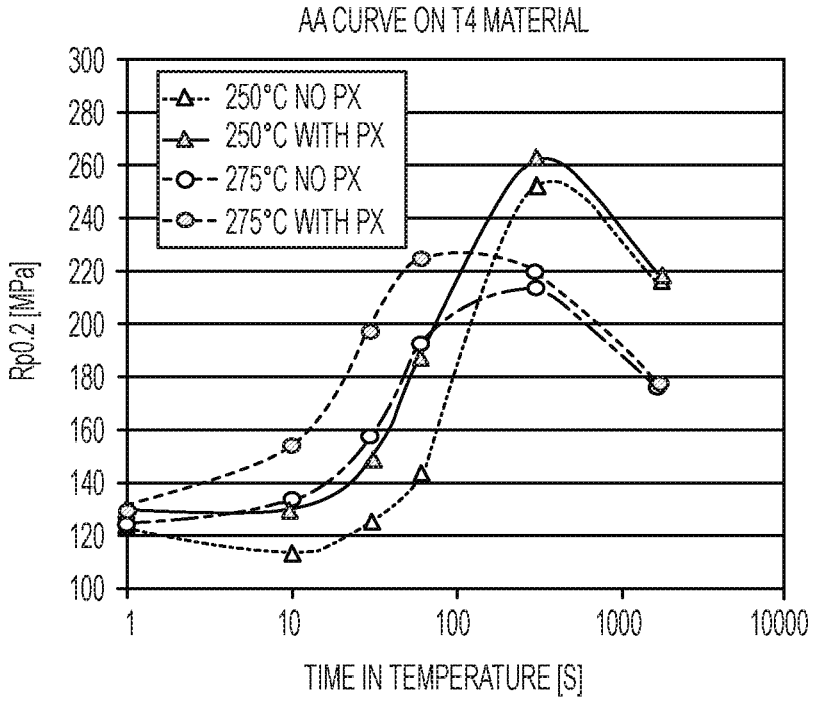
FIGS. 14A-B are graphs of $R_{p0.2}$ as a function of time at different temperatures for preaged and non-preaged alloys in T4 temper and T4 with 2% prestrain.
Figure 14B:
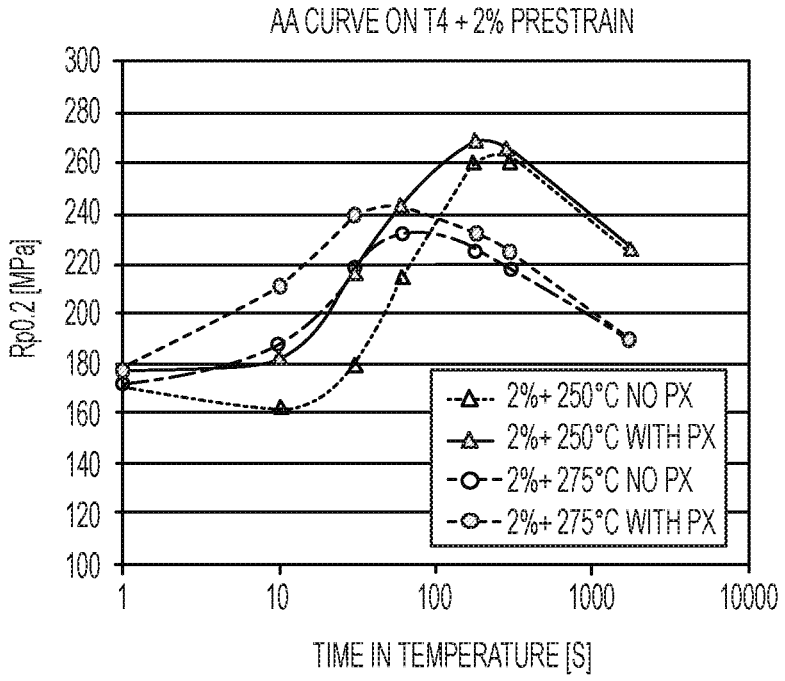

Preaged and non-preaged samples of AA6451 in T4 temper were shock heat treated in a Collin® press at 250° C. and 275° C. Preaged and non-preaged samples of AA6451 in T4 temper with 2% prestrain were also heated in a Collin® press at 250° C. and 275° C. FIG. 14 shows the aging curves of the samples. FIG. 14A shows $R_{p0.2}$ (MPa) as a function of time for the T4 materials, with "PX" indicating preaging, and FIG. 14B shows $R_{p0.2}$ as a function of time for the T4+2% prestrain materials, again with "PX" indicating preaging. After the shock heat treatment, preaged T4 AA6451 treated at both 250° C. and 275° C. provided a higher strength than the analogous non-preaged samples. Likewise, after the shock heat treatment, preaged T4 with 2% prestrain AA6451 treated at both 250° C. and 275° C. provided a higher strength than the analogous non-preaged samples.

Example 7

Integration of Shock Heat Treatment in Automotive Production Process

Figure 15:
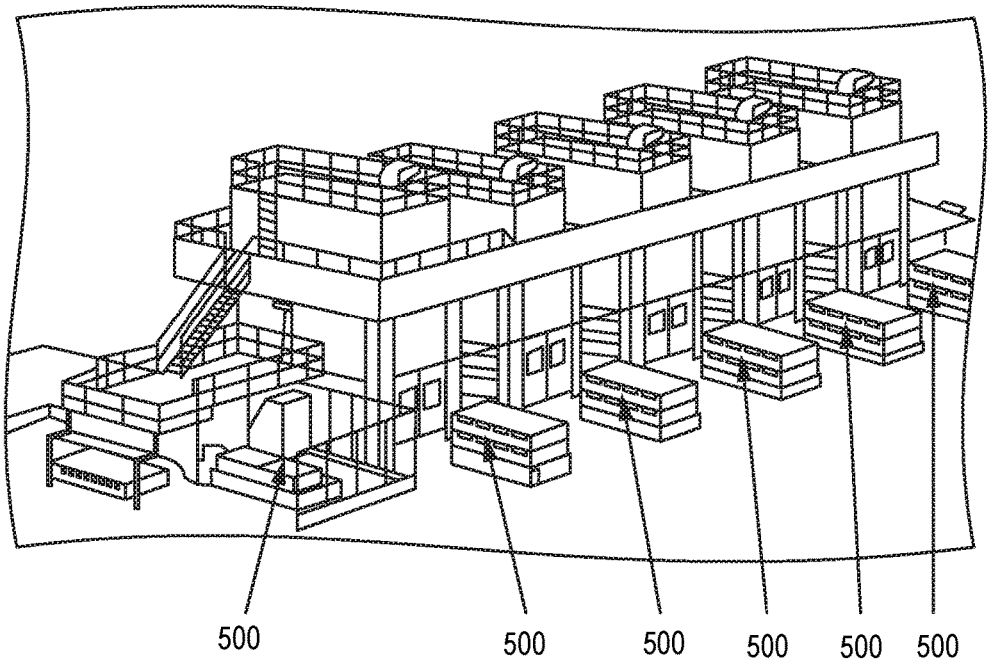
FIG. 15 is a schematic illustrating integration of shock heat treatment in press line stamping.

Shock heat treatment steps may be integrated in a production line for fabrication of pressed automotive panels. The shock heat treatment steps may be integrated at any point where such treatment may be advantageous. For example, shock heat treatment steps may be integrated after a pressing station, in one or more locations between presses in a series of pressing stations, and/or after the last press in the series. One example of a production line is schematically shown in FIG. 15. The sequence of presses is arranged as five pressing stations. The production line illustrated in FIG. 15 includes up to five pressing stations (presses) needed to achieve the final shape of the panel. During an exemplary process, there is a waiting period before or between the pressing stations due to the need to transfer the panels to the pressing station. One or more shock heat treatment steps may be implemented during these waiting periods, as shown by the arrows 500 in FIG. 15. The length of time fits the stamping speed. In one instance, the shock heat treatment step is integrated into the production cycle by adding a contact heating station after the last pressing station. In another instance, the shock heat treatment step is integrated into the production cycle by adding a contact heating station between pressing stations four and five. In one more instance, several shock heat treatment steps are integrated into the production cycle by adding a contact heating station after each of the pressing stations or in between the pressing stations. The shock heat treatments are conducted for 5 to 30 seconds at the contact stations integrated between the pressing stations. If a shock heat treatment step requires more than 30 seconds, for example, 30 to 60 seconds, such a step is added at the contact heating station integrated after the last pressing station. Integration of the shock heat treatment into the production line reduces production costs.

All patents, patent applications, publications, and abstracts cited above are incorporated herein by reference in their entirety. Various embodiments of the invention have been described in fulfillment of the various objectives of the invention. These embodiments are merely illustrative of the principles of the invention. Numerous modifications and adaptations thereof will be readily apparent to those of skill in the art without departing from the spirit and scope of the invention as defined in the following claims.

The invention claimed is:

1. A process for preparing an aluminum alloy article, comprising:

shaping an aluminum alloy sheet of an age-hardenable, heat-treatable aluminum alloy to form a shaped aluminum alloy article having one or more parts, wherein the shaping comprises stamping, pressing, or press-forming the aluminum alloy sheet;

heating at least one part of a shaped aluminum alloy article having one or more parts, two or more times to a heat treatment temperature of 250 to 300° C. at a heating rate of 10 to 220° C./second; and, maintaining the heat treatment temperature for each heat treatment for a time period of 60 seconds or less, wherein the at least one part of the shaped aluminum alloy article comprises an age-hardenable, heat-treatable aluminum alloy.

2. The process of claim 1, wherein each heat treatment temperature is maintained for 5 to 30 seconds.

3. The process of claim 1, wherein the age-hardenable, heat-treatable aluminum alloy is a 2xxx, 6xxx or 7xxx series aluminum alloy.

4. The process of claim 1, wherein the age-hardenable, heat-treatable aluminum alloy is in T4 temper prior to the heating steps.

5. The process of claim 1, wherein the age-hardenable, heat-treatable aluminum alloy is in T6 or T61 temper after the heating steps.

6. The process of claim 1, wherein yield strength of the age-hardenable, heat-treatable aluminum alloy is increased after the heating steps by at least 30 to 50 MPa.

7. The process of claim 1, wherein the heating is conductive heating.

8. The process of claim 1, wherein the heating is by application of one or more heated dies.

9. The process of claim 1, wherein the at least one part is the entire shaped aluminum alloy article.

10. The process of claim 1, wherein the at least one part is at least two parts, and wherein the at least two parts of the shaped aluminum alloy article are heated at the same or different temperatures.

11. The process of claim 1, wherein the heating is conducting two times and wherein the second time period is different from the first time period.

12. The process of claim 1, wherein the heating is conducting two times and wherein the first heat treatment temperature and the second heat treatment temperature are two different temperatures.

13. The process of claim 12, wherein the second heat treatment temperature is lower than the first heat treatment temperature.

14. The process of claim 1, wherein the shaped aluminum alloy article is a motor vehicle panel.

* * * * *